United States Patent [19]

Akers

[11] Patent Number: 4,950,851

[45] Date of Patent: Aug. 21, 1990

[54] FAST OPERATOR

[75] Inventor: Donald J. Akers, Chicago, Ill.

[73] Assignee: Joslyn Corporation, Ill.

[21] Appl. No.: 232,223

[22] Filed: Aug. 15, 1988

[51] Int. Cl.[5] ..... H01H 33/42

[52] U.S. Cl. ..... 200/148 F; 200/148 B; 335/30

[58] Field of Search ..... 200/144 R, 148 B, 148 F; 335/28, 30

[56] References Cited

U.S. PATENT DOCUMENTS 2,858,395 10/1958 Harm et al. ..... 335/30

3,947,650 3/1976 Strain et al. ..... 200/148 B

*Primary Examiner*—Robert S. Macon

*Attorney, Agent, or Firm*—Mason, Kolehmainen, Rathburn & Wyss

[57] ABSTRACT

A control circuit for a circuit interrupting switch having a non-stored energy operator reduces the time period between a switch command and a change of the switch contacts. The time period is reduced by prearming the mechanical operating linkage after each switch operation. By prearming the mechanical operating linkage, the linkage has less distance to travel and hence the time period between a switch command and a change in the switch contacts is greatly reduced.

17 Claims, 3 Drawing Sheets

FAST OPERATOR

BACKGROUND OF THE INVENTION

1. Field of the Invention

This invention relates to a circuit interrupting switch for use at relatively high voltages and, more particularly, to control circuitry for an operator for opening and closing the contacts of such a switch wherein the switch is normally prearmed in a pre-close or pre-open position to reduce the time period between a switch command and operation of the switch contacts.

2. Description of the Prior Art

Circuit interrupting switches are generally old and well known in the art. An example of such a switch is disclosed in U.S. Pat. No. 3,947,650, assigned to the assignee of the present invention. Such switches utilize a snap-action mechanism, such as the snap-action mechanism disclosed in U.S. Pat. No. 3,908,473, for opening and closing the switch contacts. The snap-action mechanism, which includes a spring, is not used to store energy in a non-active state. When a switch operation is desired, a lever arm, disposed outside the switch housing, is used to transfer energy to the snap-action mechanism. Once sufficient energy has been transferred to the spring, continued motion of the lever will release a mechanical latch. Release of the latch allows the spring to open or close the switch contacts.

The total time for the switch to operate in response to a command is comprised of two time periods; namely, the charging or prearming time and the switch contact operation time. The prearming time is the time it takes to transfer sufficient energy to the spring in the snap-action mechanism to cause the switch contacts to open or close. The charging or prearming time does not influence the switch contact operation time. This prearming time is controlled by the speed of travel of the lever arm which may be either manually operated or motor operated. The switch contact operation time is the time it takes the switch contacts to operate after the latch has been released. This time period is relatively small as compared to the prearming time.

FIG. 1 is a one line diagram of a pair of circuit interrupting switches used to feed a critical load. With such an arrangement, the configuration of the circuit interrupting switches would be such that one switch would be closed and the other switch opened at one time. This would allow a preferred source of electrical power to be connected to the critical load during normal operation. However, if the preferred source becomes unavailable, the configuration of the circuit interrupting switches is reversed so as to connect the alternate source and disconnect the preferred source from the critical load. With conventional circuit interrupting switches, typical motor operations would take approximately six seconds (three seconds for each switch). However, there are certain applications where six seconds would be unacceptable, such as lighting systems used for night sports events, and the like. For such applications, in order to solve this problem, the equipment would have to be replaced with interrupting devices with stored energy mechanisms. Such equipment replacement is relatively expensive.

SUMMARY OF THE INVENTION

It is an object of the present invention to provide control circuitry for an operator for a circuit interrupting switch that overcomes the problems associated with the prior art.

It is a further object of the present invention to provide control circuitry for an operator for a circuit interrupting switch which greatly reduces the time period between a switch command and the change of status in the circuit interrupting switch contacts.

Briefly, the present invention relates to control circuitry for a normally non-stored energy operator for a circuit interrupting switch which reduces the time period between a switch command and change of status of the circuit interrupting switch contacts. In order to reduce the time between a switch command and operation of the switch contacts, the control circuitry causes a spring within the snap-action mechanism, a non-stored energy operator, to be normally precharged or prearmed. By prearming the spring, the time between a switch command and change of status of the circuit interrupting switch contacts is greatly reduced. More particularly, after each circuit interrupting switch operation, the control circuit prearms the spring for the next operation. For example, after the circuit interrupting switch contacts are closed, the control circuitry causes the motor to transfer sufficient energy to the snap-action mechanism to prearm the circuit interrupting switch for an open operation. Similarly, when the circuit interrupting switch contacts are opened, the control circuitry causes the motor to transfer sufficient energy to the snap-action mechanism to prearm the device for a close operation.

DESCRIPTION OF THE DRAWING

These and other objects, advantages and novel features of the present invention will become readily apparent upon consideration of the following detailed description and attached drawing wherein:

FIG. 6 is a cross-sectional view of the circuit interrupting switch along line 6—6 of FIG. 5;

DETAILED DESCRIPTION

Figure 1:
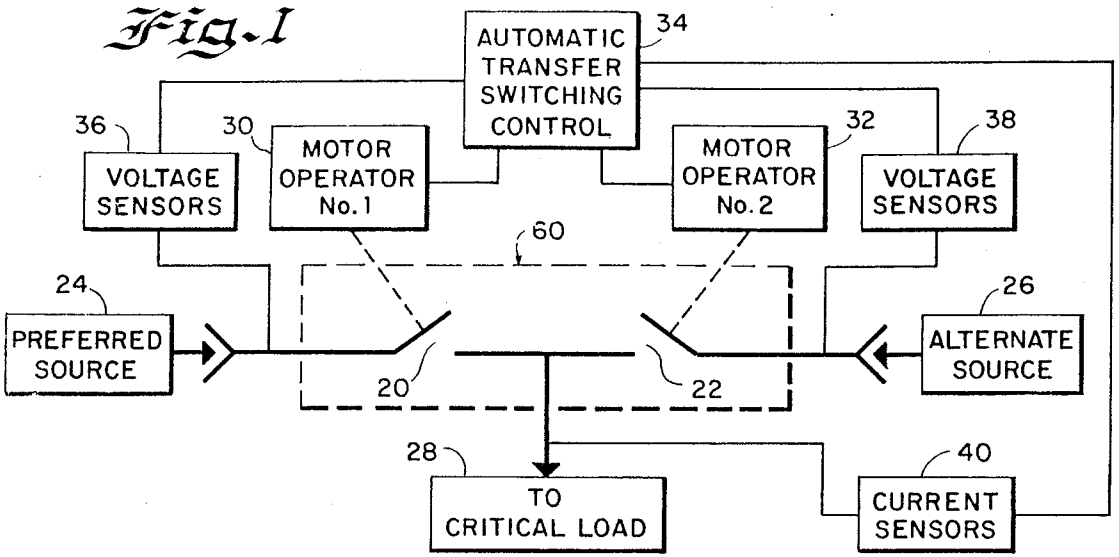
FIG. 1 is a one line diagram illustrating a pair of circuit interrupting switches feeding a critical load.

FIG. 1 is a one line diagram of a pair of electrically operated switches in an automatic transfer scheme. More particularly, a pair of circuit interrupting switches 20 and 22 are used to connect a preferred and alternate source of electrical power 24 and 26, respectively, to a critical load 28. In normal operation, only one circuit interrupting switch 20 or 22 is closed at a time. The circuit interrupting switches 20 and 22 are provided with corresponding motor operators 30 and 32, respectively. The motor operators 30 and 32 are controlled by an automatic transfer switching control circuit 34 which does not form a part of the present invention.

In general, the automatic transfer switching control circuit 34 will automatically transfer to the alternate source of electrical power 26 when the preferred source 24 is unavailable. In some automatic transfer switching control systems, the system will switch back to the preferred power source 24 when it becomes re-available even though the alternate source 26 is also available.

Voltage sensors 36 and 38, which are coupled to the line side of the circuit interrupting switches 20 and 22, are used to provide information to the automatic transfer switching control circuit 34 as to the availability of the sources 24 and 26, respectively. Current sensors 40 are used to provide an indication of whether current is being applied to the critical load 28. The current sensors 40 may also be used to indicate whether there is a fault at the critical load 28. If a fault condition exists at the critical load 28, the circuit interrupting switches 20 and 22 would open to isolate the fault, but allow the sources 24 and 26 to supply electrical power to other loads.

During a transfer from one source to the other, which would normally take six seconds for prior art circuit interrupting switches, the control circuit in accordance with the present invention reduces the transfer time substantially. This is accomplished by prearming the circuit interrupting switch mechanical operator More particularly, after a circuit interrupting switch is closed or opened, the control circuit causes the operator to move the mechanical linkage to a prearming position for the opposite contact state. For example, after the circuit interrupting switch has been opened, the control circuit in accordance with the present invention causes the mechanical linkage to travel to the pre-close position. The mechanical operator remains in that position until the circuit interrupting switch is commanded to close. At that point, the circuit interrupting switch closes resulting in a much shorter travel time for the mechanical actuator, thus greatly reducing the time between a switch command and operation of the circuit interrupting switches 20 and 22. After the switch is fully closed, the mechanical linkage travels to the preopen position. The control circuit functions similarly after the circuit interrupting switch has been closed.

In prior art, non-stored energy type circuit interrupting switches, the mechanical linkage remains at either the fully open or fully closed position. Thus, when the switch is commanded to open or close, the mechanical linkage must travel a substantial distance to arm the snap-action mechanism before there is a change in the status of the switch contacts. As previously discussed, this takes approximately three seconds. By prearming the switches in both the open and close positions, the travel distance and travel time of the mechanical linkage used to control the interrupting contact is greatly reduced.

Figure 2:
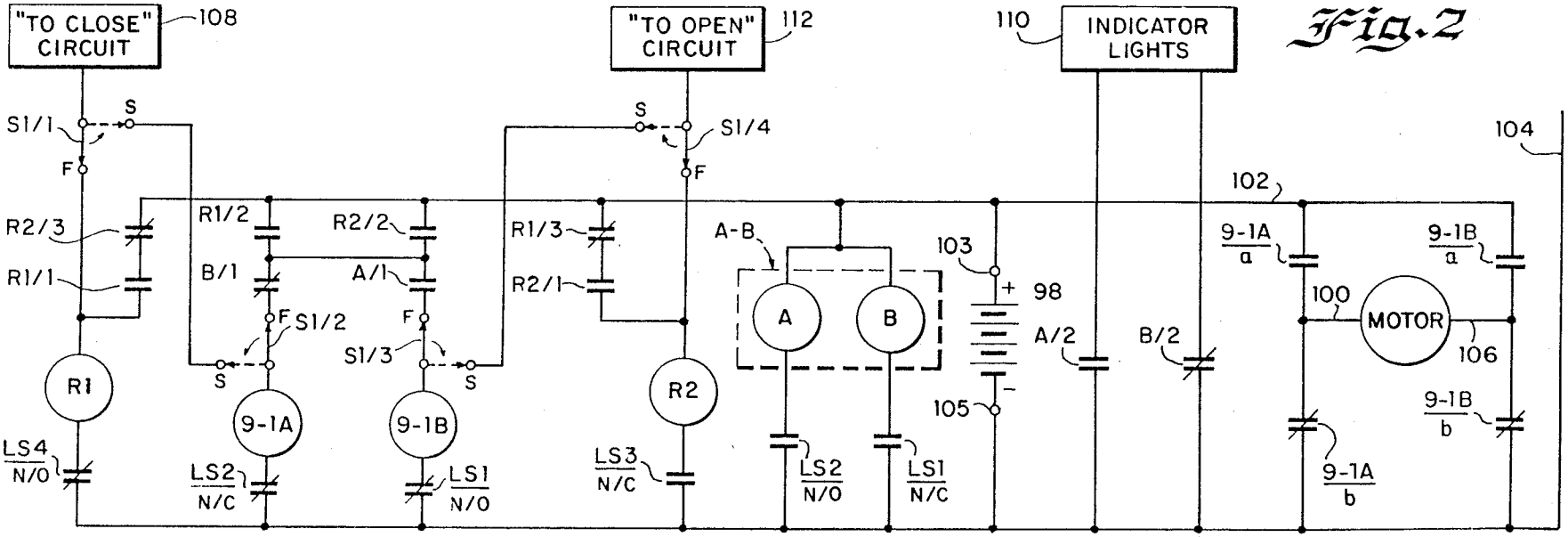
FIG. 2 is a schematic diagram of a control circuit in accordance with the present invention.
Figure 3:
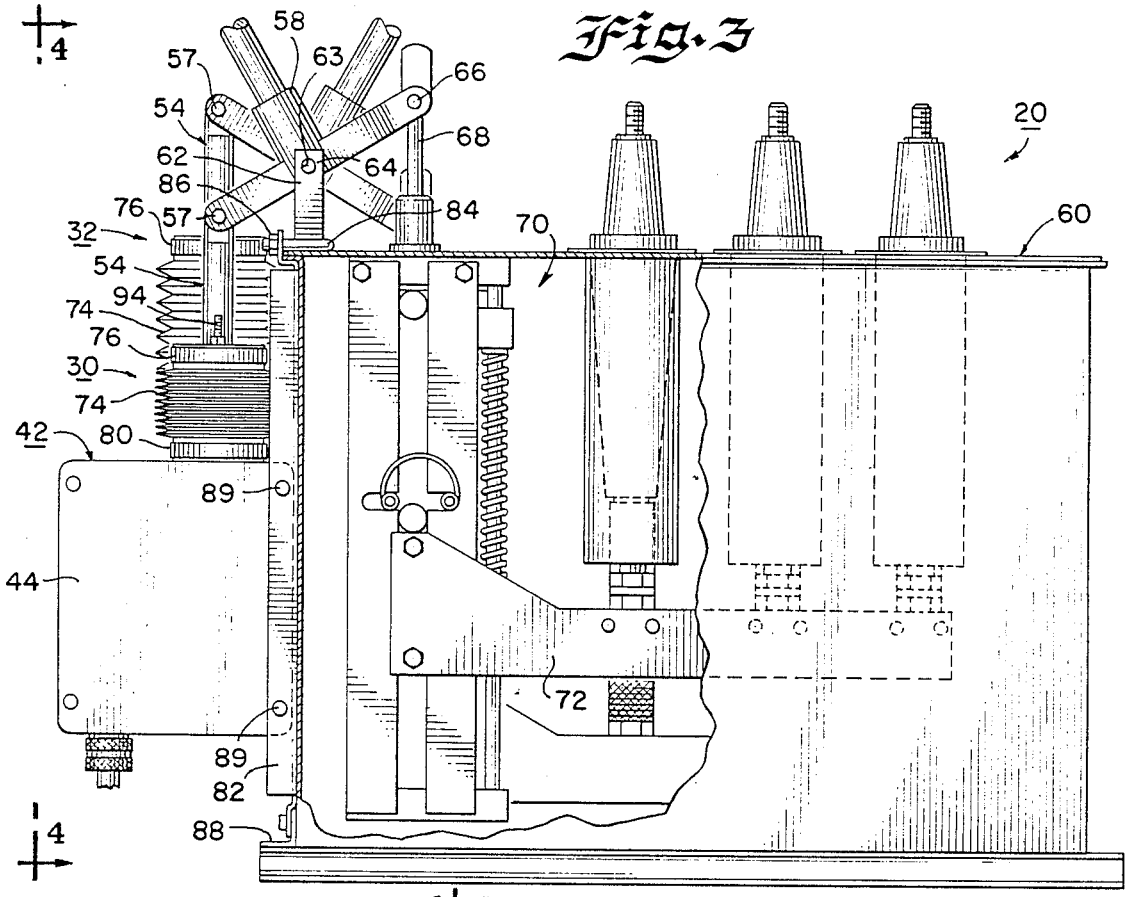
FIG. 3 is a side elevation of a circuit interrupting switch in accordance with the present invention partially broken away illustrating the motor operator and associated mechanical linkage in the foreground in the fully closed position and in the in the fully opened position in the background.
Figure 4:
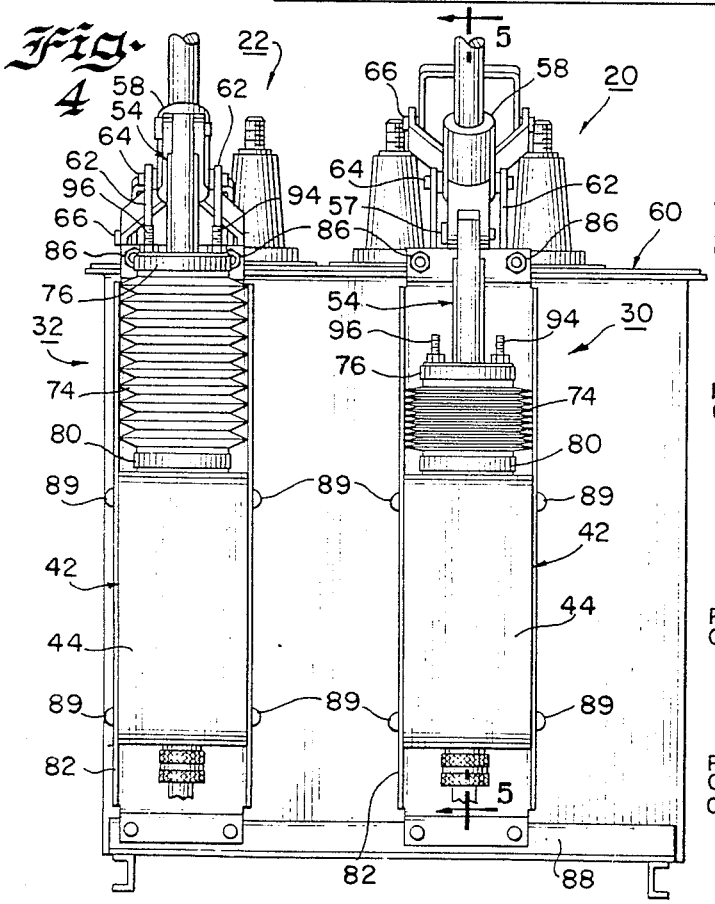
FIG. 4 is an end elevation of a circuit interrupting switch in accordance with the present invention showing the right hand motor operator in the fully closed position and the left hand motor operator in the fully opened position.
Figure 5:
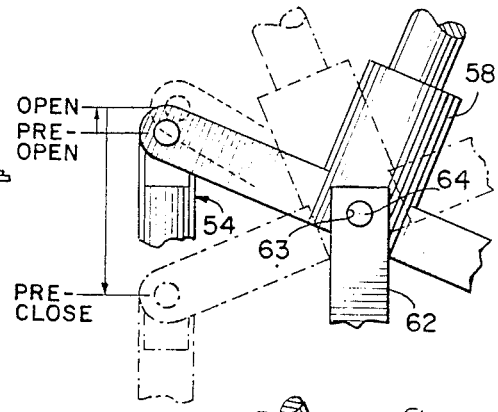
FIG. 5 is a cross-sectional view of the motor operator for the circuit interrupting switch along line 5—5 of FIG. 4.

The system in accordance with the present invention is implemented with a motor operator and associated control linkage, generally identified by the reference numeral 42, as illustrated in FIGS. 3–7, and a control circuit as illustrated in FIG. 2. The system may be added on to an existing manually operated circuit interrupting switch 20 or 22 in the field. The motor operator mechanism 42 includes a housing 44 for enclosing a motor 46, mechanically coupled at one end to a gear box 48. The gear box 48 is coupled to a cylindrical housing 50 (FIG. 5). The cylindrical housing 50 is provided with an axial bore for receiving a piston 52. The piston 52 is provided with a threaded axial bore (not shown). The threaded axial bore of the piston 52 rides on a threaded shaft (not shown) driven by the gear box 48. In operation when the motor 46 is running, the threaded shaft causes the piston 52 to move axially, either upwardly or downwardly depending on the direction of rotation of the motor 46 and provides an anti-reversing feature to keep the spring within the snap-action mechanism from causing the motor 46 to be driven in reverse.

The piston 52 is connected to one end of an elongated linkage 54. The elongated linkage 54 is provided with a transverse bore at one end 55, aligned with a transverse bore on the piston 52. The elongated linkage 54 is connected to the piston 52 by way of a pin 56, received in the transverse bores in the piston 52 and elongated linkage 54. The other end of the linkage 54 is provided with an aperture and aligned with an aperture in the T-shaped rocker arm 58 for receiving a Pin 57 to provide a pivotal connection between the elongated linkage 54 and the T-shaped rocker arm 58.

The T-shaped rocker arm 58 is also pivotally connected to the top of the circuit interrupting switch housing 60 by way of a bracket 62. The housing 60 may be hermetically sealed and filled with $SF_6$ gas. The bracket 62 is an elongated U-shaped member, fixedly secured to the switch housing 60 at one end and having an aperture 63 at the other end. The aperture 63 is aligned with an aperture in the T-shaped rocker arm 58. A pin 64 is received in the apertures in the bracket 62 and the T-shaped rocker arm 58 to provide for a pivotal connection of the T-shaped rocker arm 58 to the switch housing 60. The other end of the rocker arm 58 is connected by way of a pin 66 to an input switch arm 68 which is, in turn, connected to the snap-action mechanism 70. The snap-action mechanism 70 is described in detail in U.S. Pat. No. 3,908,473 and hereby incorporated by reference. The snap-action mechanism 70 is, in turn, coupled to a crossbar 72 which is, in turn, connected to the movable contacts. The connection of the crossarm 68 to the movable contacts as well as the internal details of the circuit interrupting switch are described in detail in U.S. Pat. No. 3,947,650, assigned to the same assignee as the present invention and also hereby incorporated by reference. At least one pair of feed through bushings 23 is provided to connect the circuit interrupting switch contacts to an external electrical circuit.

A bellows 74 is attached to the elongated linkage 54 and the motor operator housing 44 to prevent dust and debris from entering the housing 44. More particularly, the bellows 74 is attached to the elongated linkage 54 by way of a clamp 76. The other end of the bellows 74 is fit over an integrally formed nipple 78 in the housing 44 and secured to the nipple 78 by way of a clamp 80.

Since the rocker arm 58 and the elongated linkage 54 will travel in an arcuate path, the assembly of the motor operator 46, gear box 48 and the cylindrical housing 50 are pivotally mounted to the housing 44 by way of a shoulder screw 81. The shoulder screw 81 allows the assembly of the motor operator 46, gear box 48 and housing 50 to pivot to allow the elongated linkage 54 to travel in an arcuate path.

The housing 44 is attached to the switch housing 60 by way of a channel 82. More specifically, the channel 82 is connected to a bracket 62, rigidly secured to the top of the switch housing 60, by way of a U-bolt 84 and fasteners 86. The channel 82 is connected to a base channel 88 rigidly secured to the bottom of the switch housing 60. The motor operator housing 44 is connected to the channel 82 by suitable fasteners 89 along one edge of the housing 44. Thus, the mechanical linkage can easily and quickly be retrofit to existing circuit interrupting switches in the field.

The cylindrical housing 50, located inside the housing 44, is provided with four limit switches LS1, LS2, LS3 and LS4. Limit shoulders LS1 and LS2 are mounted to detect the extreme end positions of travel which correspond to a condition where the contacts are opened or switch closed. More particularly, limit switch LS1 is mounted to detect the condition when the elongated linkage 54 is fully extended, as shown in the background in FIG. 3. This corresponds to a condition where the circuit interrupting switch contact is open. The limit switch LS2 is disposed on the circular housing 50 to indicate the other extreme position of travel of the elongated linkage 54; namely, when the elongated linkage 54 is fully retracted, as shown in FIG. 5. This corresponds to the condition when the circuit interrupting switch contacts are closed. Two other limit switches LS3 and LS4 are located on the circular housing 50 to detect intermediate positions of travel of the elongated linkage 54. More particularly, the limit switch LS3 is located to detect the condition when the elongated linkage 54 is in a pre-close position. The limit switch LS4 is located on the housing 50 to detect a condition when the elongated linkage 54 is in a pre-open position.

The limit switches LS1, LS2, LS3 and LS4 are rigidly attached to a mounting bracket 90 which is, in turn, secured to the housing 50 by way of a clamp 92. As shown best in FIGS. 5–7, limit switches LS1 and LS4 are located approximately 180 degrees from limit switches LS2 and LS3, respectively. A pair of actuating rods 94 and 96, rigidly secured to a flange 97, formed on one end of the elongated linkage 54, are disposed diametrically opposite each other. The actuating rods 94 and 96 are used to actuate the limit switches LS1, LS2, LS3 and LS4. More particularly, the actuating rod 94 is used to actuate the limit switches LS1 and LS4 while the actuating rod 96 is used to actuate the limit switches LS2 and LS3. Since movement of the elongated linkage 54 causes the circuit interrupting switch contacts to open or close and the actuating rods 94 and 96 are secured to the elongated linkage 54, movement of the elongated linkage 54 and the actuating rods 94 and 96 allow the position of the circuit interrupting switch contacts to be detected.

The control circuit in accordance with the present invention is illustrated in FIG. 2 in the form of electromechanical relays for purposes of illustration; however, it should be understood that the actual implementation of the control circuit can be other than as shown in FIG. 1 with various electronic implementations possible.

Figure 10:
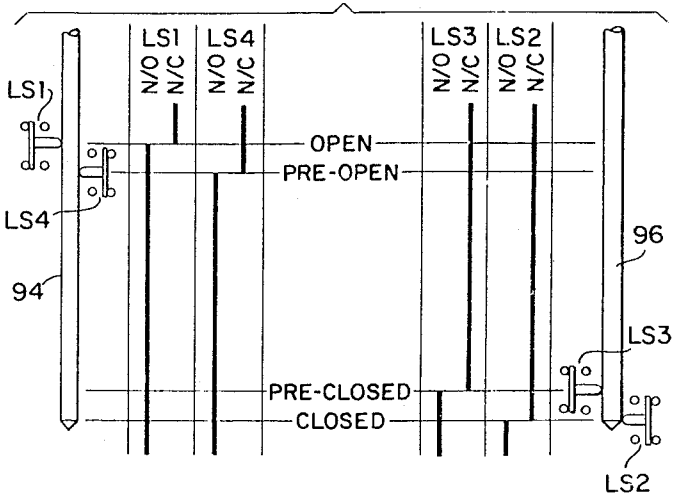
FIG. 10 is a limit switch functional operation chart.

The status notation used in the control circuit in FIG. 2 for the limit switches LS1, LS2, LS3 and LS4 is best understood with reference to FIG. 10. FIG. 10 is a functional diagram of the limit switches showing the contact status of each of the limit switches LS1, LS2, LS3 and LS4 for the various positions of the actuating rods 94 and 96. Each of the limit switches LS1, LS2, LS3 and LS4 are provided with two contacts; one normally opened and one normally closed. Each pair of contacts may be tied together at one end in what is known as a "form C" contact configuration. In such a configuration, the status of the contacts is always complementary. For example, when the normally open (N/0) contact is open, the normally closed (N/C) contact will be closed. Similarly, when the N/0 contact is closed the N/C contact will be open.

The circuit illustrated in FIG. 2 is adapted for two modes of operation: a fast mode of operation wherein the mechanical operating mechanism is advanced to a prearm condition for the opposite circuit interrupting switch contact status after each operation. For example, after the contacts of the circuit interrupting switch 20 are closed, the mechanical operating mechanism will proceed to the pre-open position. Similarly, after the contacts of the circuit interrupting switch 20 are opened, the mechanical operating mechanism will travel to the pre-close position. This is accomplished by reversing the motor operator 30 after each switch operation to allow the mechanical operating mechanism to travel to the opposite contact status prearm position.

The other mode of operation is a slow mode of operation wherein the motor operator 30 is not reversed after each switch operation, and hence the mechanical linkage, once it travels to the extreme open or closed positions will remain there. This mode of operation is used to facilitate adjustment of the limit switches LS1 and LS2.

The mode of operation is selected by actuating a selector switch S1. The selector switch S1 is a four pole, two-position switch. As shown in FIG. 2, the fast position is shown in solid line while the slow position is shown in dotted line.

The motor 46 is a direct current (DC) motor. The power supply for the motor 46 is provided by a battery 98 which also supplies power to the control circuit. In order to use a single motor for both extending and retracting the mechanical operating linkage to open and close the switch contacts, the polarity of the power supply connection to the motor 46 is reversed by way of contacts from a pair of relays 9-1A and 9-1B, as will be described in detail. More particularly, one motor terminal 100 is connected to a normally open contact 9-1A/a which, in turn, is connected to a conductor 102. The conductor 102 is connected to the positive polarity terminal 103 of the battery 98. The motor terminal 100 is also connected to a conductor 104 by way of a normally closed contact 9-1A/b. The conductor 104 is connected to a negative polarity terminal 105 of the battery 98. Since the contacts 9-1A/a and 9-1A/b are complementary, the positive terminal 100 of the motor 46 can be connected to either the positive battery terminal 103 or the negative battery terminal 105 at one time. The other motor terminal 106 is connected to a normally open contact 9-1B/a. The other side of the contact 9-1B/a is connected to the conductor 102. The motor terminal 106 is also connected to a normally closed contact 9-1B/b which, in turn, is connected to the conductor 104. Since the contacts 9-1B/a and 9-1B/b are complementary, the motor terminal 106 can only be connected to one or the other of the conductor 102 or the conductor 104 at one time.

In operation, when the circuit interrupting switch 20 or 22 is commanded to close, the contact 9-1A/a will be closed and the contact 9-1A/b will be open, which will cause the motor terminal 100 to be connected to the positive battery terminal 103. During this condition, the contact 9-1B/a will be open and the contact 9-1B/b will be closed, causing the motor terminal 106 to be connected to the negative battery terminal 105.

When the circuit interrupting switch 20 is commanded to open, the contact 9-1A/a will be open and the contact 9-1A/b will be closed. This will cause the motor terminal 100 to be connected to the negative battery terminal 105. The contact 9-1B/a will be closed and the contact 9-1B/b will be open causing the motor terminal 106 to be connected to the positive battery terminal 103. By reversing the polarity of the power supply 98 to the motor terminals 100 and 106, the direction of rotation of the motor 46 will reverse its direction.

As previously discussed, the control circuit is capable of being operated in two different modes: a slow mode and a fast mode. In the slow mode of operation, the mechanical operating mechanism will be at one of the two extreme positions after it is actuated (e.g., open or closed). In the slow mode of operation, the selector switch S1 is placed in the "slow" position, shown in dotted lines in FIG. 2. When a signal from a close circuit 108 is received, the relay 9-1A will be energized through a normally closed contact LS2/NC of the limit switch LS2. The LS2/NC contact, as shown in FIG. 10, is closed in all positions except when the mechanical operating mechanism is in the fully closed position. Thus, when a command from the closed circuit 108 is received, the limit switch contact LS2/NC will be closed. This limit switch contact LS2/NC will hold the relay 9-1A energized until the mechanical operating mechanism is in the fully closed position at which point the contact LS2/NC will open, dropping out the relay 9-1A which, in turn, deenergizes the motor 30.

While the relay 9-1A is energized, the motor terminal 100 will be connected to the positive battery terminal 103, while the motor terminal 106 will be connected to the negative battery terminal 105 causing the motor 46 to run in one direction. The motor 46 will continue to run until the mechanical operating mechanism reaches the fully closed position at which point, it will stop when the relay 9-1A drops out. When the mechanical operating mechanism reaches the fully closed position, another limit switch contact LS2/NO will close, thereby energizing the A coil of the latching relay A-B. The A coil will be latched until the complementary unlatch or B coil is energized. Once the A coil is energized, the contact B/1 will open and the contact A/2 will close, thereby illuminating a closed indicator light, shown in block form and identified with the reference numeral 110. The indicating lights indicate the position of the contacts and not the position of the motor.

When it is desired to open the circuit interrupting switch in the slow mode, a signal from an open circuit 112 is applied to one side of a relay 9-1B. The other side of the relay 9-1B is connected to the conductor 104 by way of a limit switch contact LS1/NO. The limit switch contact LS1/NO is closed in all positions except in the fully open position. The limit switch LS1/NO will hold the relay 9-1B energized until the circuit interrupting switch is fully open.

Once the relay 9-1B is energized, the contact 9-1B/a will close and the contact 9-1B/b will open causing the motor terminal 106 to be connected to the positive battery terminal 103 and the motor terminal 100 to be connected to the negative battery terminal 105 through the contact 9-1A/b, which will be closed in this condition. The motor 46 will run until the circuit interrupting switch 20 or 22 reaches the fully open position at which time the limit switch contact LS1/NO will open, causing the relay 9-1B to drop out which, in turn, causes the motor 46 to stop.

When the circuit interrupting switch reaches the fully open position, the limit switch contact LS1/NC will close causing the B coil of the latching relay A-B to be picked up. Once the B coil of the latching relay A-B is picked up, the contact A/1 will open and the contact B/2 will close which, in turn, will illuminate an indicator light 110 indicating that the circuit interrupting switch is open. Even though the motor has advanced to the preclose position, the indicating light will indicate the position of the contacts and not the motor.

As should be clear, the limit switches LS1 and LS2, which are located at the extreme ends of travel of the mechanical operating linkage, are used to cause the motor 46 to travel to either the open or closed positions. In the slow mode of operation, the motor 46 is controlled to stop at the extreme positions to allow the limit switches LS1 and LS2 to be adjusted.

The limit switches LS3 and LS4 are located at intermediate positions to allow the motor 46 to reverse direction and prearm the mechanical operating mechanism to shorten the time between a switch command and change of status of the circuit interrupting switch contacts.

The fast mode of operation is selected by the selector switch S1. When the selector switch S1 is placed in the "fast mode" position, the mechanical operating mechanism will open or close the circuit interrupting switch 20 and reverse the motor 46 to travel to the prearm position for the opposite contact status state. The fast mode position of the selector switch S1 is shown in solid line in FIG. 2. When a close signal is received from a closed circuit 108, the relay R1 is energized through a limit switch contact LS4/NO. The limit switch contact LS4/NO is closed in all positions except the pre-open and the fully open positions. Since the fast operator circuitry causes the mechanical operating linkage to rest in either the pre-open or pre-close position, this contact would have been normally closed in the preclose position prior to receiving a close signal from the closed circuit 108. The contact LS4/NO will remain closed until the mechanical operating linkage reaches the pre-open position.

Once the relay R1 is energized, it, in turn, energizes the relay 9-1A by way of the contacts R1/2 and B/1, which will all be closed in this condition, to complete a closed circuit path to the relay 9-1A. A contact R1/3 is used to prevent the relay R2 from being energized while the relay R1 is energized. Similarly, the contact R2/3 in the relay 9-1A circuit path prevents the relay from being energized when the relay 9-1B is energized. The contact B/1 will remain closed until the mechanical operating linkage is in the fully closed position at which point the limit switch contact LS2/NO closes. The A coil of the latching relay A-B will be picked up through the contact LS2/NO causing the contact A/1 to close and the B/1 contact to open. Also, once after the switch operating mechanism reaches the fully closed position, the relay R1 will continue to be energized through the limit switch contact LS4/NO, which will remain closed until the mechanical switch mechanism reaches the pre-open position.

Once the mechanical operating linkage reaches the fully closed position, the A coil of the latching relay A-B will be energized through the LS2/NO contact closing the A/1 contact and opening the B/1 contact. The closing of the A/1 contact provides a complete circuit path to the relay 9-1B while the B/1 contact opens the current to the relay 9-1A. Once the relay 9-1B is energized, the polarity of the power supply 98 to the motor is reversed as heretofore discussed. The relay 9-1B will continue to be energized until the mechanical operating mechanism reaches the preopen position at which point the limit switch contact LS4/NO will open causing the relay R1 to be deenergized which, in turn, will open the contacts R1/1 and R1/2 which, in turn, will deenergize the relay 9-1B and the motor 30. Thus, it should be clear that when the circuit is operated in the fast mode, the mechanical operating linkage will be actuated to close the circuit interrupting switch, and once the fully closed position is reached, the control circuitry will reverse the direction of the motor 46 to cause the mechanical operating linkage to travel in the opposite direction; to the pre-open position.

With the selector switch S1 in the fast mode of operation coincident with an open signal from the open circuit 112, the relay R2 is energized by way of a limit switch contact LS3/NC. The limit switch contact LS3/NC is closed in all positions except in the pre-close and closed positions, where they are open. As heretofore discussed, after the circuit interrupting switch was last closed, the mechanical operating linkage reverses and travels to the preopen position. In the pre-open position, the limit switch contact LS3/NC will be closed, to allow the relay R2 to be energized upon receipt of an open signal. When the relay R2 is energized, a circuit path, which includes the contacts R2/1 and R1/3, will hold the relay R2 energized until the contact LS3/NC opens in the prearmed to closed position. The R2/2 and A/1 contacts will then energize the relay 9-1B through the contact LS1/NO.

When the relay R2 is energized, it will, in turn, energize the relay 9-1B. The relay 9-1B will cause the motor terminal 106 to be connected to the positive battery terminal 103 and the terminal 100 of the motor 46 to be connected to the negative battery terminal 105. The motor 46 will be energized in this manner until the mechanical operating linkage reaches the fully open position, at which point the contact LS1/NC will energize the B coil of the latch relay B causing the contacts A/1 to open and B/1 to close. This will provide a closed circuit path to the relay 9-1A by way of the contacts R2/2 and B/1. Once the relay 9-1A is energized, the direction of rotation of the motor 46 is reversed in the manner as heretofore discussed. The relay R2 remains energized until the mechanical operating mechanism reaches the pre-close position at which point the limit switch contact LS3/NC opens which deenergizes the relay R2 which, in turn, deenergizes the relay 9-1A and stops the motor 46. Thus, it should be clear when a signal is received from the open circuit, the control circuitry causes the mechanical operating linkage to travel to the fully open position and then reverses the polarity of the power supply 98 to the motor 46 to reverse the direction of rotation of the motor 46 and cause the mechanical operating linkage to travel to the fully closed position.

Figure 9:
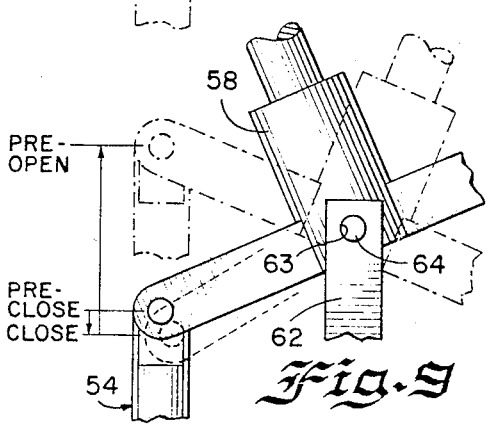
FIG. 9 is a partial view of the mechanical linkage for the circuit interrupting switch in accordance with the present invention in the pre-close position in solid line; in the closed position in dashed lines; and the fully closed position in alternating dots and dashes.
Figures 5, 7, 8:
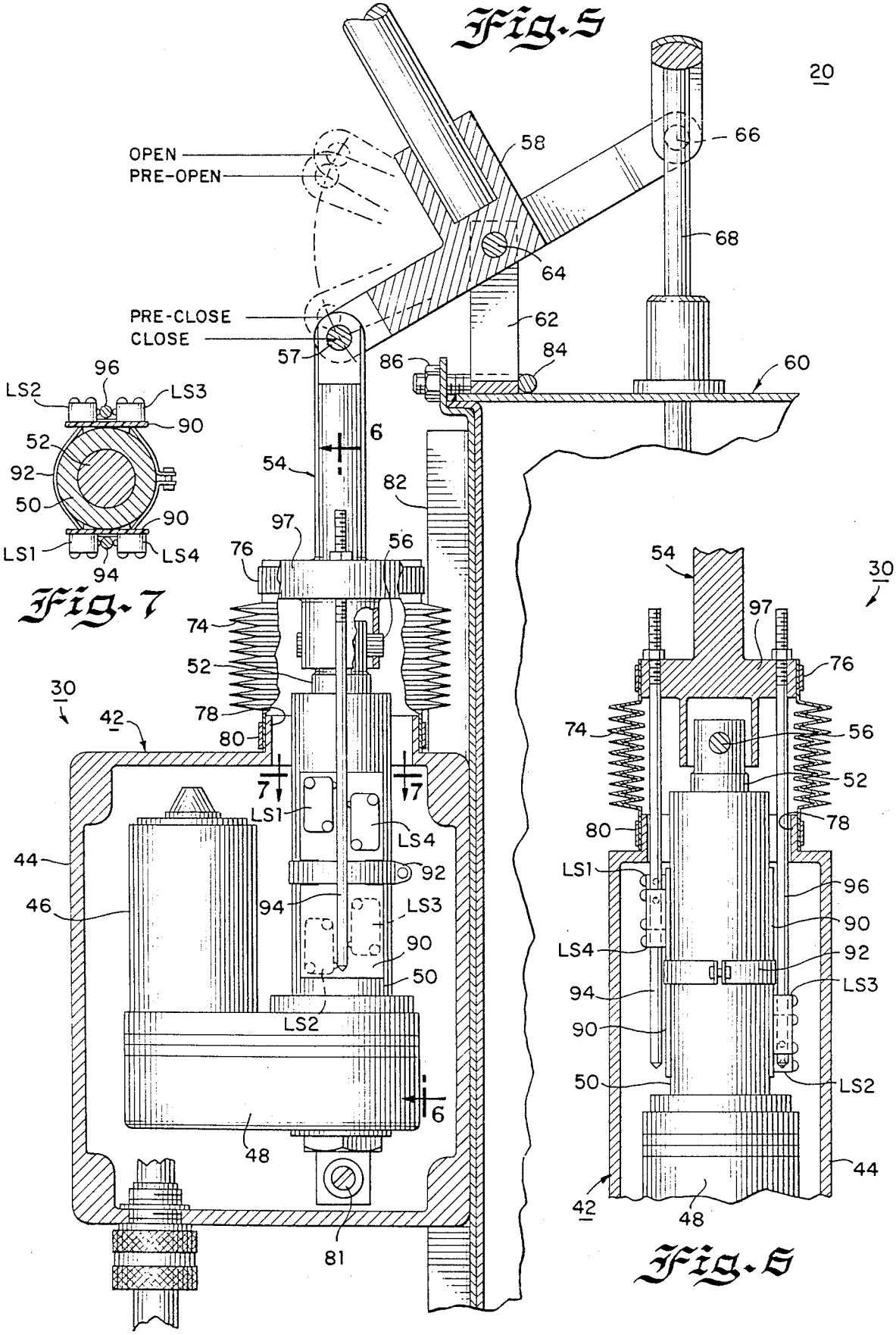
FIG. 7 is a cross-sectional view of the circuit interrupting switch along line 7—7 of FIG. 5.
FIG. 8 is a partial view of the mechanical linkage for the circuit interrupting switch in accordance with the present invention in the pre-open position in solid lines; the fully opened position in dashed lines; and the fully closed position in alternating dots and dashes.

The operating positions of the mechanical linkage are best shown in FIGS. 5, 8 and 9. In FIG. 5, the solid lines indicate the position of the mechanical linkage in the fully closed position. Phantom lines are used to indicate the position of the rocker arm 58 in the pre-close, pre-open and opened positions. As heretofore discussed, stopping in the extreme positions of travel, such as fully open or fully closed, is only possible with the control circuit of the present invention when the system is operated in a slow mode of operation. The slow mode of operation is used only to adjust the end limit switches LS1 and LS2 to ensure that the endpoints are past the point of release of the latches in the snap-action mechanism.

FIGS. 8 and 9 show the positions of the mechanical operating linkage when the control circuitry of FIG. 2 is operated in the fast mode of operation. More particularly, FIG. 8 shows the position of the mechanical operating linkage in the pre-open position in solid line; the fully open position in dashed line and the fully closed position in alternating dots and dashes. FIG. 9 shows the position of the mechanical operating linkage in the pre-close position in solid line and the fully closed position in dashed line. The fully opened position is shown in alternating dots and dashes.

Since a typical actuator must move approximately three inches between the fully open and fully closed position, the travel time using a conventional motor operator is about three seconds. By allowing the actuator to advance to a pre-close or pre-open position, the time to operate the switch upon command will be greatly reduced. The total travel time remains the same; however, by tacking the prearming time at the end of an operation cycle, the time period between a switch command and change of status of the contacts of the circuit interrupting switch is greatly reduced.

Obviously many modifications and variations of the present invention are possible in light of the above teachings. Thus, it is to be understood that, within the scope of the appended claims, the invention may be practiced otherwise than as specifically described hereinabove.

What is claimed and desired to be secured by Letters Patent is:

1. A circuit interrupting device comprising:
a housing;
at least one pair of interrupting contacts disposed in said housing;
means for electrically connecting said pair of interrupting contacts to an external electrical circuit;
means for opening and closing said pair of interrupting contacts in a predetermined time period from a command;
means for prearming said opening and closing means after each switch operation to reduce said predetermined time period between a command and the opening or closing of said interrupting contacts.

2. A circuit interrupting device as recited in claim 1 wherein said housing is hermetically sealed.

3. A circuit interrupting device as recited in claim 2 wherein said housing is filled with $SF_6$ gas.

4. A circuit interrupting device as recited in claim 1 wherein said prearming means includes an electric motor.

5. A circuit interrupting device comprising:

a housing;

at least one pair of interrupting contacts disposed within said housing;

means for electrically connecting said pair of interrupting contacts to an external electrical circuit;

a non-stored energy device mechanically coupled to said pair of interrupting contacts for opening or closing said pair of interrupting contacts upon command in a predetermined time period; and means for prearming said non-stored energy device after each operation of said interrupting contacts.

6. An operator for a circuit interrupting switch having at least one pair of interrupting contacts disposed in a switch housing mechanically coupled to a snap-action mechanism, coupled to a first reciprocally mounted linkage to allow the interrupting contacts to be opened and closed upon command, which at least partially extends through said switch housing comprising:

an operator housing;

means disposed within said operator housing for prearming said snap-action mechanism after each contact operation; and means which includes a second linkage for mechanically coupling said prearming means to said reciprocally mounted linkage.

7. An operator as recited in claim 6 wherein prearming means includes a motor operator.

8. An operator as recited in claim 6 wherein said operator housing is rigidly connected to said switching housing.

9. An operator as recited in claim 6 wherein said prearming means is pivotally mounted with respect to said operator housing.

10. An operator as recited in claim 6 wherein said mechanical coupling means includes means for determining the relative position of said second linkage.

11. An operator as recited in claim 10 wherein said determining means includes at least one limit switch.

12. An operator as recited in claim 11 wherein said second linkage includes means for actuating said limit switches coupled to said second linkage.

13. An operator as recited in claim 12 wherein said actuating means includes at least one actuating rod.

14. An operator as recited in claim 6 further including means coupled to said second linkage and said operator housing for preventing dust and other foreign particles from entering the actuator housing.

15. An operator as recited in claim 14 wherein said preventing means includes a bellows.

16. An operator as recited in claim 10 wherein said determining means includes two limit switches; each limit switch mounted to detect the positions of the second linkage which correspond to the fully open and fully closed positions.

17. An operator as recited in claim 16 wherein said determining means further includes an additional two limit switches; each limit switch mounted to detect the positions of the second linkage which correspond to a pre-close and a pre-open position.

* * * * *